US006540009B1

(12) United States Patent
Naruse et al.

(10) Patent No.: US 6,540,009 B1
(45) Date of Patent: Apr. 1, 2003

(54) HOLDING STRUCTURE FOR CONTINUOUS CASTING LONG STOPPER

(75) Inventors: Noriyoshi Naruse, Ena (JP); Naoki Yamada, Ena (JP)

(73) Assignee: Akechi Ceramics Kabushiki Kaisha, Gifu (JP)

( * ) Notice: Subject to any disclaimer, the term of this patent is extended or adjusted under 35 U.S.C. 154(b) by 0 days.

(21) Appl. No.: 09/648,073

(22) Filed: Aug. 25, 2000

(51) Int. Cl.[7] ..... B22D 11/18; B22D 41/08
(52) U.S. Cl. ..... 164/412; 164/437; 222/602
(58) Field of Search ..... 164/412, 437; 222/602, 271

(56) References Cited

U.S. PATENT DOCUMENTS 3,281,904 A 11/1966 Murton
5,024,422 A * 6/1991 Fishler et al. ..... 266/272
5,851,414 A * 12/1998 Ando et al. ..... 222/602

FOREIGN PATENT DOCUMENTS

DE 40 28 793 A1 3/1992
DE 198 23 988 A1 12/1999

* cited by examiner

*Primary Examiner*—M. Alexandra Elve
*Assistant Examiner*—Len Tran
(74) *Attorney, Agent, or Firm*—Koda & Androlia

(57) ABSTRACT

A holding structure for a continuous casting long stopper includes a continuous casting long stopper including a shaft insertion hole formed in an upper end thereof, a protrusion insertion groove contiguous to and axially opposed to the shaft insertion hole, and a horizontal engagement groove contiguous to a lower end of the protrusion insertion groove, and a holding rod including a shaft inserted into the shaft insertion hole, the shaft having a lower end on which a radially protruding locking protrusion is formed. In the structure, after the shaft of the holding rod is inserted into the shaft insertion hole such that the locking protrusion reaches the protrusion insertion groove, the locking protrusion is caused to engage the engagement groove by rotation of either the shaft of the holding rod or the long stopper relative to the other.

4 Claims, 5 Drawing Sheets

HOLDING STRUCTURE FOR CONTINUOUS CASTING LONG STOPPER

BACKGROUND OF THE INVENTION

1. Field of the Invention

This invention relates to a holding structure for a long stopper used in continuous casting. The continuous casting long stopper will hereinafter be referred to as "long stopper."

2. Description of the Prior Art

In the prior art, an insert screw brick t or a spindle u is conventionally used when a long stopper s is held on a holding rod r, as shown in FIGS. 7A and 7B. The screw brick t or the spindle u is screwed so that the long stopper s is connected to the holding rod r. Thereafter, a lock nut w is screwed down on the rod r to lock the long stopper s. A gap between a female screw x of the long stopper s and the screw brick t or the spindle u is filled with mortar y serving both a sealing material and a cushioning material. Furthermore, a pin z is driven into holes formed across the long stopper s and the rod r respectively as shown in FIG. 7C.

In the above-described screwed type, however, mortar adherent to an outer circumference of the screw brick t or the spindle u needs to be removed away every time the long stopper s is replaced. The removing work is troublesome and time-consuming. Furthermore, the pin z needs to be driven into and out of holes of the long stopper s and the rod r every time the long stopper is replaced. Particularly when the long stopper s is of the gas blowing type, sealing against air is rendered incomplete.

SUMMARY OF THE INVENTION

Therefore, an object of the present invention is to provide a holding structure for a continuous casting long stopper which can simplify replacement of the long stopper, provide a stable engagement between the long stopper and the holding rod, prevent disengagement during operation, and be applied to the long stopper of the gas blowing type.

The present invention provides a holding structure for a continuous casting long stopper, comprising a continuous casting long stopper including a shaft insertion hole formed in an upper end thereof, a protrusion insertion groove contiguous to and axially opposed to the shaft insertion hole, and a horizontal engagement groove contiguous to a lower end of the protrusion insertion groove, and a holding rod including a shaft inserted into the shaft insertion hole, the shaft having a lower end on which a radially protruding locking protrusion is formed. In the structure, after the shaft of the holding rod is inserted into the shaft insertion hole such that the locking protrusion reaches the protrusion insertion groove, the locking protrusion is caused to engage the engagement groove by rotation of either the shaft of the holding rod or the long stopper relative to the other.

According to the above-described structure, the shaft of the holding rod is inserted into the shaft insertion hole of the long stopper, and the locking protrusion is inserted into the protrusion insertion groove to reach its lower end. Either the shaft or the long stopper is rotated relative to the other so that the locking protrusion engages the engagement groove, whereby the long stopper is attached to the holding rod. When the long stopper is to be detached from the holding rod, either the shaft or the long stopper is rotated relative to the other so that the locking protrusion disengages from the engagement groove. Consequently, since the long stopper is attached to and detached from the holding rod with ease, the long stopper can easily be replaced by a new one.

In a preferred form, the holding rod includes a flange fixed thereto, the long stopper has an upper end face, and the holding rod is provided with a coil spring disposed between the flange and the upper end face of the long stopper. Consequently, an axially urging force of the coil spring can firmly engage the locking protrusion with the engagement groove.

In another preferred form, the holding rod includes a ring fitted with the shaft thereof and having a detent pin mounted thereon so as to extend axially with respect to the holding rod. Furthermore, the flange has a detent pin insertion hole which is in alignment with the protrusion insertion groove of the long stopper when the locking protrusion of the holding rod is in engagement with the engagement groove of the long stopper. Additionally, the detent pin has a lower end inserted into the protrusion insertion groove of the long stopper. In this structure, the lower end of the detent pin is inserted into the insertion groove of the long stopper so that rotation of the holding rod is prevented. Consequently, even when the long stopper is repeatedly subjected to an axial shock or impact during operation, the rotation of either the rod or the long stopper relative to the other can be prevented, whereupon the engagement protrusion can be prevented from disengaging from the engagement groove.

In further another preferred form, the long stopper has a stopper head formed with a through hole through which a gas is caused to blow out of the stopper head. Consequently, the holding structure can be applied to long stoppers of the inert gas blowing type.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENT

Figure 1:
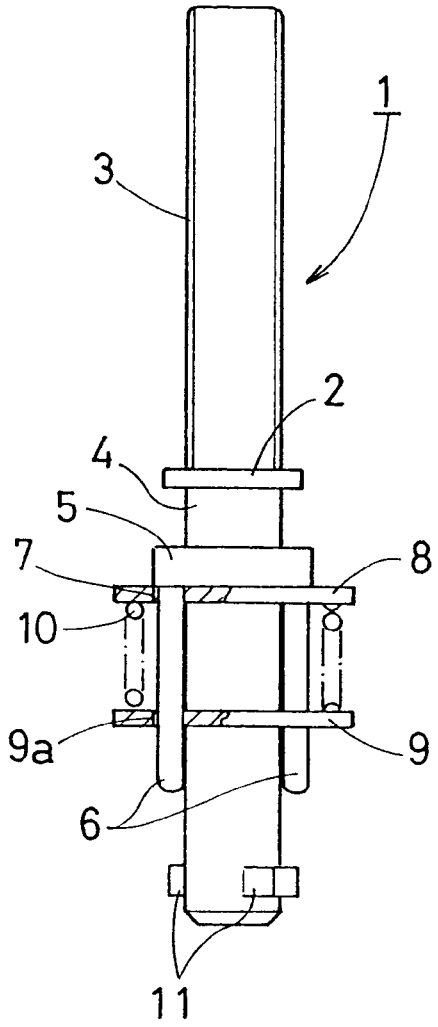
FIG. 1 is a partially cut-away front view of a holding rod of the holding structure of an embodiment in accordance with the present invention.

One embodiment of the present invention will be described with reference to the accompanying drawings. Referring to FIG. 1, a holding rod 1 includes a central collar 2, a female screw 3 extending upward from the collar, and a shaft 4 extending downward from the collar. A ring 5 which abuts the collar 2 is inserted from a lower end of the rod 1. The ring 5 has a pair of detent pins 6 radially opposed to each other and protruding downward. A flange 8 is welded to the shaft 4 of the rod 1. The flange 8 has two detent pin insertion holes 7 into which the detent pins 6 are inserted respectively. A spring seat 9 is loosely fitted with the rod 1 so as to be opposed to the flange 8. A coil spring 10 is provided between the flange 8 and the spring seat 9. The coil spring 10 has both ends welded to the flange 8 and the spring seat 9 respectively. The spring seat 9 is also formed with two insertion holes 9*a* into which the detent pins 6 are inserted respectively. The shaft 4 of the rod 1 has on its lower end a pair of radially protruding locking protrusions 11.

Figure 2:
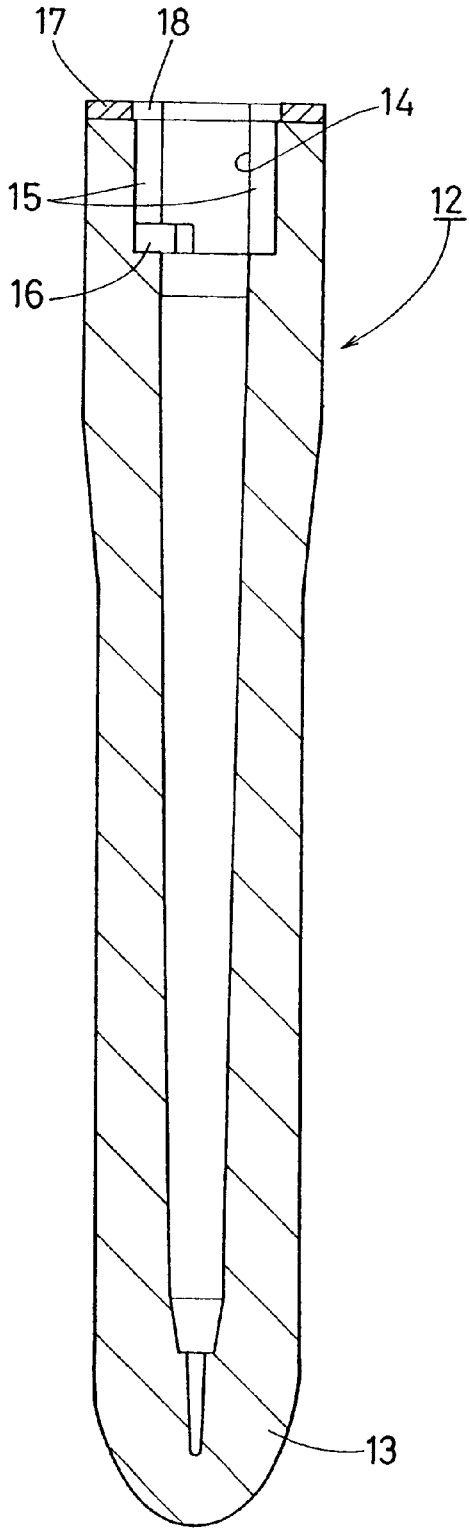
FIG. 2 is a sectional view of a long stopper.

Referring now to FIG. 2, a long stopper 12 includes a lower end formed into a generally spindle-shaped stopper head 13. The long stopper 12 has in its upper end a shaft insertion hole 14. The shaft 4 of the rod 1 is inserted into the shaft insertion hole 14. The shaft insertion hole 14 has two protrusion insertion grooves 15 formed to be radially opposed thereto. The locking protrusions 11 of the rod 1 are inserted into the protrusion insertion grooves 15 respectively. Each protrusion insertion groove 15 has a lower end formed with a horizontal engagement groove 16 circumferentially contiguous thereto. When reaching the lower ends of the protrusion insertion grooves 15, the locking protrusions 11 are caused to engage the respective engagement grooves 16 by rotation of either the shaft 4 or the long stopper 12 relative to the other. When the locking protrusions 11 are in engagement with the respective grooves 16, the protrusion insertion grooves 15, the detent pin insertion holes 7 and the insertion holes 9*a* are in phase or alignment with one another. A cushioning member 17 is mounted on an upper end of the long stopper 12. The cushioning member 17 has a hole 18 corresponding to the insertion holes 14 and 15.

Figure 3:
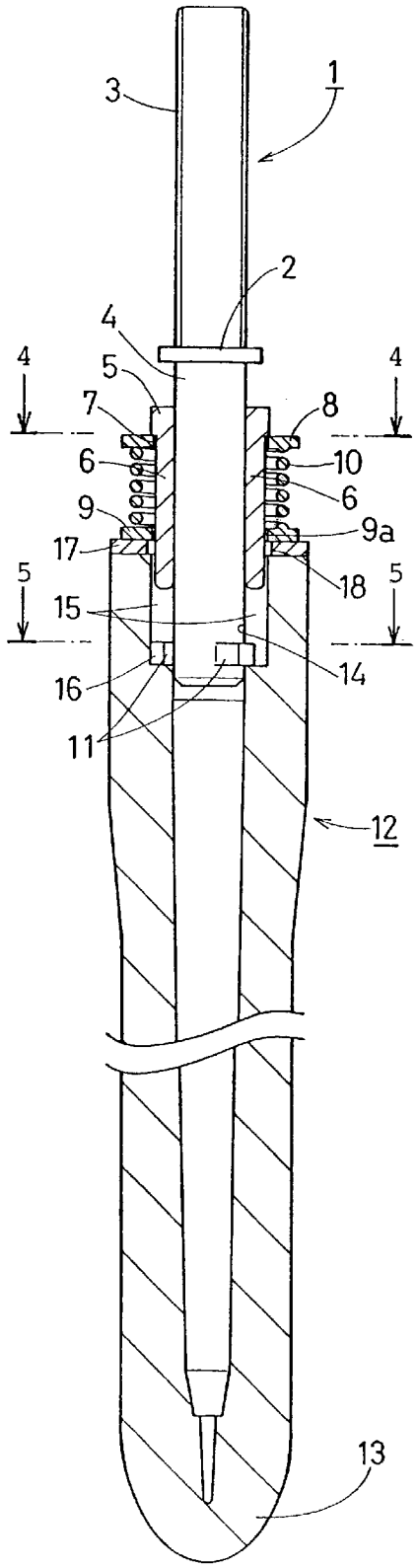
FIG. 3 is a sectional view of holding rod on which the long stopper is held.
Figure 4:
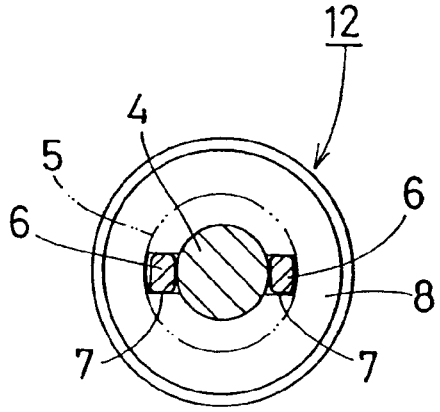
FIG. 4 is a sectional view taken along line 4—4 in FIG. 3.
Figure 5:
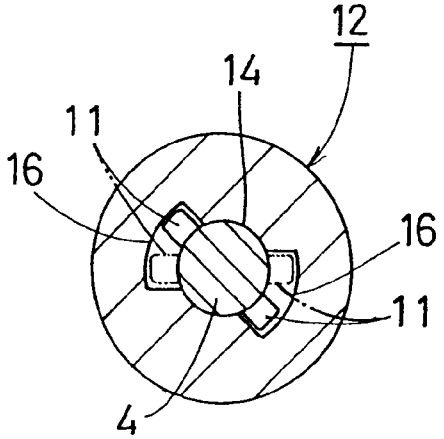
FIG. 5 is a sectional view taken along line 5—5 in FIG. 3.
Figure 6:
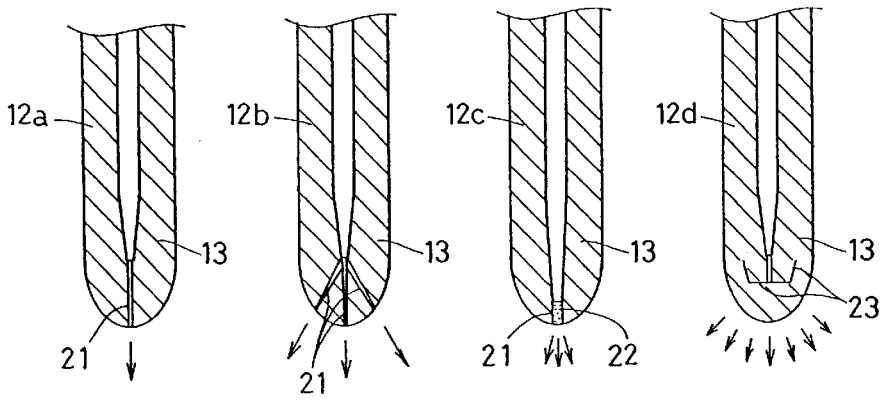
FIGS. 6A to 6D schematically show other long stoppers.
Figure 7:
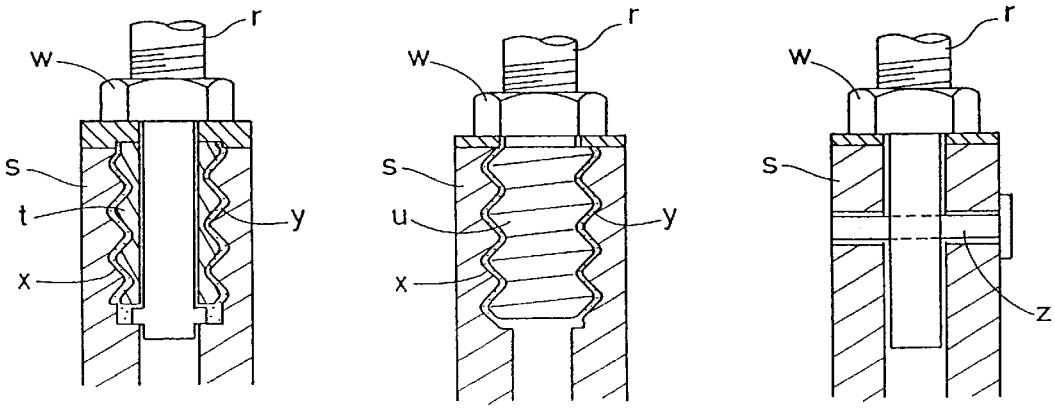
FIGS. 7A, 7B and 7C schematically show conventional holding structures respectively.

When the long stopper 12 is to be attached to the rod 1, the protrusions 11 of the shaft 4 are inserted into the respective protrusion insertion holes 15 of the long stopper 12, and the shaft 4 is inserted into the insertion hole 14 while the upper end face of the long stopper 12 and the spring seat 9 are caused to come close to each other so that the coil spring 10 is compressed. When the protrusions 11 reach lower ends of the protrusion insertion holes 15 respectively, either the shaft 4 or the long stopper 12 is rotated relative to the other so that the protrusions 11 are caused to engage the respective grooves 16 as shown in FIG. 5. At this time, an axially urging force of the coil spring 10 located between the upper end face of the long stopper 12 and the flange 8 renders the engagement of the protrusions 11 with the respective grooves 16 firm and stable. When the protrusions 11 are in engagement with the respective grooves 16 as shown in FIG. 3, the insertion grooves 15, the insertion holes 7 and the insertion holes 9*a* are in phase or alignment with one another. Accordingly, the lower ends of the detent pins 6 provided on the ring 5 are inserted through the insertion holes 7 of the flange 8, the insertion holes 9*a* of the spring seat 9 and the insertion grooves 15 respectively, whereupon the rod 1 and the long stopper 12 can be prevented from rotation relative to each other.

When the long stopper 12 is to be detached from the rod 1 to be replaced by a new one, the detent pins 6 are pulled out through the insertion holes 7 and 9*a* and insertion grooves 15 respectively. Thereafter, either the shaft 4 or the long stopper 12 is rotated relative to the other so that the protrusions 11 are caused to disengage from the respective grooves 16 and the shaft 4 is pulled out of the insertion hole 14.

According to the above-described holding structure, either the shaft 4 of the holding rod 1 or the long stopper 12 is rotated relative to the other so that the rod is attached to and detached from the long stopper 12. Consequently, the long stopper can easily be replaced by a new one. Furthermore, since the coil spring 10 is provided between the upper end face of the long stopper 12 and the flange 8, the axial urging force of the coil spring renders the engagement of the protrusions 11 with the respective grooves 16 firm and stable. Furthermore, the lower ends of the detent pins 6 having passed through the detent pin insertion grooves 7 are inserted into the protrusion insertion grooves 15 for the purpose of preventing rotation of either the rod 1 or the long stopper 12 relative to the other. Consequently, even when the long stopper 12 is repeatedly subjected to an axial shock or impact during operation, the rotation of either the rod 1 or the long stopper 12 relative to the other can be prevented, whereupon the protrusions 11 can be prevented from disengaging from the respective grooves 16.

FIGS. 6A to 6D illustrate different long stoppers 12*a* to 12*d* of the inner gas blowing type respectively. The present invention can be applied to each of the illustrated long stoppers. The long stopper 12*a* has a gas blowing hole 21 formed in the distal end of the stopper head 13. The long stopper 12*b* has a plurality of gas blowing holes 21. In each long stopper, large bubbles can be produced by the blown gas. The long stopper 12*c* includes a porous plug 22 fitted in the gas blowing hole 21. The long stopper 12*d* has gas blowing slits 23 formed in the distal end of the stopper head 13. In each case, small bubbles can be produced by the blown gas.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A holding structure for a continuous casting long stopper, comprising:

a continuous cat long stopper including a shaft insertion hole formed in an upper end thereof, a protrusion insertion groove contiguous to and axially opposed to the shaft insertion hole, and a horizontal engagement groove contiguous to a lower end of the protrusion insertion groove; and a holding rod including a shaft inserted into the shaft insertion hole, the shaft having a lower end on which a radially protruding locking protrusion is formed;

wherein:

after the shaft of the holding rod is inserted into the aft insertion hole such that the locking protrusion reaches the protrusion insertion groove, the locking protrusion is caused to engage the engagement groove by rotation of either the shaft of the holding rod or the long stopper relative to the other; and the holding rod includes a flange fixed thereto, the long stopper has an upper end face, and the holding rod is provided with a coil spring disposed between the flange and the upper end face of the long stopper, whereby firm and stable engagement between said insertion groove and said locking protrusion is provided and said long stopper is simply attached to and detached from said holding rod.

2. The structure according to claim 1, wherein the holding rod includes a ring fitted with the shaft thereof and having a detent pin mounted thereon so as to extend axially with respect to the holding rod, wherein the flange has a detent pin insertion hole which is in alignment with the protrusion insertion groove of the long stopper when the locking protrusion of the holding rod is in engagement with the engagement groove of the long stopper, and wherein the detent pin has a lower end inserted into the protrusion insertion groove of the long stopper.

3. The structure according to claim 1, wherein the long stopper has a stopper head formed with a through hole through which a gas is caused to blow out of the stopper head.

4. The structure according to claim 2, wherein the long stopper has a stopper head formed with a through hole through which a gas is caused to blow out of the stopper head.

* * * * *